US007062180B2

(12) United States Patent
Suzuki

(10) Patent No.: US 7,062,180 B2
(45) Date of Patent: Jun. 13, 2006

(54) IMAGE FORMING DEVICE WITH IMAGE DENSITY CONTROL

(75) Inventor: Katsuhiko Suzuki, Hitachinaka (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 170 days.

(21) Appl. No.: 10/770,524

(22) Filed: Feb. 4, 2004

(65) Prior Publication Data

US 2004/0156646 A1 Aug. 12, 2004

(30) Foreign Application Priority Data

Feb. 7, 2003 (JP) ..... 2003-030212

(51) Int. Cl.
*G03G 15/00* (2006.01)
*G03G 15/06* (2006.01)

(52) U.S. Cl. ..... 399/15; 399/49; 399/55

(58) Field of Classification Search ..... 399/15, 399/53, 55, 58, 60, 61
See application file for complete search history.

(56) References Cited

U.S. PATENT DOCUMENTS 4,786,924 A * 11/1988 Folkins ..... 399/49
5,576,811 A * 11/1996 Kobayashi et al. ..... 399/60
5,887,223 A * 3/1999 Sakai et al. ..... 399/60
5,966,561 A * 10/1999 Yamaguchi ..... 399/49 X
2004/0018025 A1* 1/2004 Park et al. ..... 399/55

FOREIGN PATENT DOCUMENTS

JP 04-034573 A * 2/1992
JP 04-319972 A * 11/1992
JP 05-323789 A * 12/1993
JP 2002-23436 1/2002

* cited by examiner

*Primary Examiner*—Sophia S. Chen
(74) *Attorney, Agent, or Firm*—Antonelli, Terry, Stout and Kraus LLP.

(57) ABSTRACT

An image forming device having a developing unit for visualizing an electrostatic latent image formed on an image carrying body by utilizing a developing agent containing toners and carriers which transfers a toner image to a recording medium to obtain a record image. A patch sensor is provided for detecting the image density of the record image, and it controls toner density stabilization control and an adjustment value and bias voltage in the developing unit according to a value detected by the patch sensor and a value of current flowing in the image carrying body from the developing unit. Thereby, an image forming device is provided which performs stable image density control when a problem is caused during processing of a predetermined number of printing pages, even when a deterioration of the image due to an abnormal property change of a developing agent is caused.

1 Claim, 1 Drawing Sheet

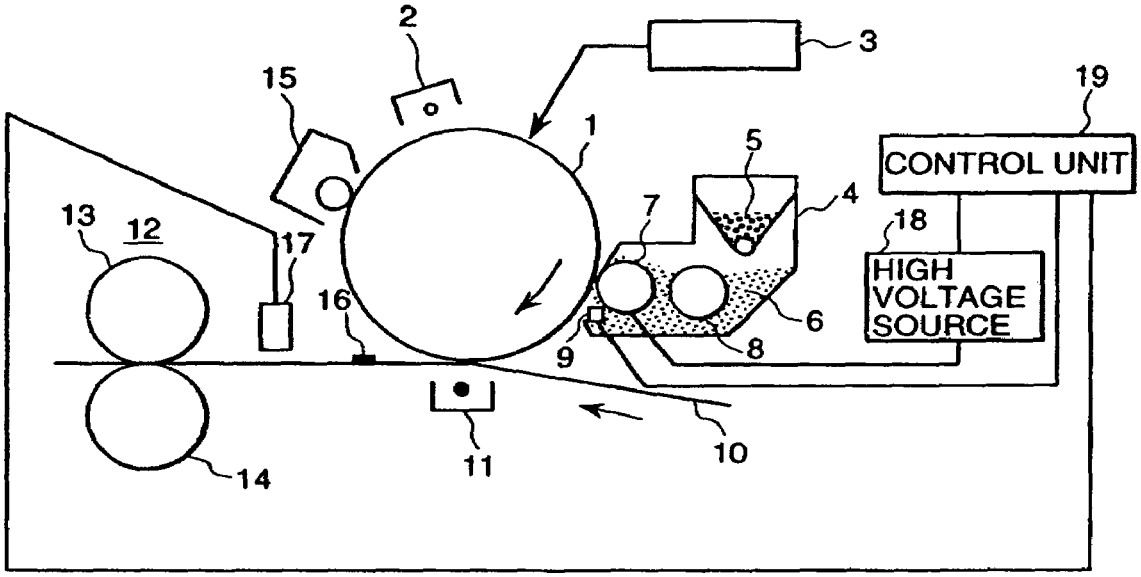
2
3
15
19
1
5
CONTROL UNIT
4
7
18
13
12
17
HIGH
VOLTAGE
SOURCE
16
6
9
8
10
11
14

IMAGE FORMING DEVICE WITH IMAGE DENSITY CONTROL

BACKGROUND OF THE INVENTION

The present invention relates to an image forming device which utilizes, for example, an electro photographic method and electrostatic recording method to repeatedly form a large number of images; and, more specifically, the present invention relates to an image forming device that has a control unit which performs adjustment of the toner density and bias voltage in a developing unit according to a value detected by a patch sensor representing the image density of a recorded image and a value of current flowing in an image carrying body from the developing unit.

In a conventional recording device using an electro photographic method, a photoconductive photo-sensitive body is uniformly charged, an image is exposed thereon, a partial discharge of electric charges is produced caused on the photosensitive body and an electrostatic latent image is formed thereon. Thereafter, the electrostatic latent image is developed with toners containing coloring agents. As an example of developing units which supply toners for the electrostatic latent image formed on the photosensitive body, other than a developing unit of the one component developing type, which uses only toners for the developing agent, there is a developing unit of the two component developing type, which uses a developing agent containing toners and carriers. Finally the toner image thus obtained is transferred and fixed on a recording medium, such as a recording paper, to obtain a record image. These processes are repeatedly performed.

The two component type developing, which uses a developing agent containing both toners and carriers, will be explained. When performing a development by supplying toners to a photosensitive body, since the toner density in the developing agent gradually decreases with the formation of successive images over time, it is required to maintain the toner density in the developing agent; therefore, when the toner density decreases to some extent, a toner replenishing the supply with unit is driven for replenishing new toners. For this reason, a toner density control unit is required, which always keeps the toner density constant.

A conventional toner density control unit will be described. The toner density in the developing agent containing both toners and carriers is measured with a toner density detector provided in the developing unit. When the output value of the detector falls below a reference set value, it is judged that the toner density has decreased, and the toner replenishing unit is driven until the value received from the toner density detector reaches the reference set value, so as to replenish the toner supply with new toners. The reference set value is determined in advance for every predetermined number of printing pages, so as to supplement the characteristic change of the developing agent, thus the toner density is always controlled to be constant.

The toner density control corresponding to a record image will be explained. The image density of a patch image transferred on a recording medium, such as a recording paper, during the transfer process is read by a patch sensor, for example. The read value is fed back to a control unit, such as a CPU in the machine main body, and, when the read image density does not reach a reference value, the toners are replenished until the reference value is reached. Thereby, through such toner density control, the image density of the record image is always kept constant, as disclosed in JP-A-2002-23436, for example.

In the conventional toner density control used in connection with two component type development, the toner density is controlled for every predetermined number of printing page; and, if a problem occurs during the interval, the image density of a patch image is directly detected and the detected value is fed back to the control system to control the toner density.

Thereby, even midway of the predetermined printing pages, the printing quality is finely controlled. However, in the conventional toner density control, there is a problem in that, when deterioration of the image density of a patch image is caused due to an abnormal property change of the developing agent, and the deterioration is countermeasured by modifying the developing conditions, such as the toner density and bias voltage, the property of the developing agent is further deteriorated and the image density of the record image can not be kept constant.

SUMMARY OF THE INVENTION

An object of the present invention is to provide an image forming device which performs a stable image density control when a problem is caused during processing of a predetermined number of printing pages, in particular, even when a deterioration of the image due to an abnormal property change of a developing agent is caused.

The above object is achieved by an electrostatic recording device which is provided with a developing unit for image visualizing of an electrostatic latent image formed on an image carrying body. The development is effected by utilizing a two component developing agent containing both toners and carriers, in which a toner image is transferred on a recording medium and the toner image transferred on the recording medium is transferred onto on another recording medium and fixed to obtain a record image. The electrostatic recording device is further provided with a patch sensor for detecting the image density of the record image, and it controls the toner density stabilization control and adjustment value and bias voltage in the developing unit according to a value detected by the patch sensor and a value of current flowing in the image carrying body from the developing unit.

BRIEF DESCRIPTION OF THE DRAWING

The FIGURE is a diagrammatic cross-sectional view schematically showing an electro-photographic type electrostatic recording device incorporating an embodiment of the present invention.

DESCRIPTION OF AN EMBODIMENT

Hereinbelow an embodiment of the present invention will be explained with reference to the figure.

The figure is a view schematically showing a cross-section of an electrostatic recording device representing the present invention. With reference to this drawing, processes performed by the present device will be explained.

A photosensitive body 1 having photoconductivity is uniformly charged by an electro-static charger 2, and then a latent image is formed through use of laser beams emitted from an optical device 3. Thereafter, a developing unit 4, which is disposed near and faces the photosensitive body 1, develops the latent image by using a developing agent composed of toners 5 and carriers. This development is performed by transporting the developing agent 6 from a transporting roll 8 to a developing roll 7, by applying a bias voltage having the same polarity as the charge polarity of the toner 5 between the photosensitive body 1 and the developing roll 7, and by bringing the developing agent 6 into contact with the photosensitive body 1.

After completing the development, the developing agent 6 into the vicinity of a toner density detector 9 that is disposed near the developing roll 7, and the ratio of the toners 5 in the developing agent 6 is detected. The toners that are developed and deposited on the surface of the photosensitive body 1 are transferred onto a sheet 10 by means of an image transfer unit 11, which applies to the toners 5 a polarity that is opposite to the charge polarity of the toners 5. The toners 5 that are transferred onto the sheet 10 are fixed on the sheet 10 by means of a fixing unit 12, which is constituted by a heat roll 13 for providing heat to the toner 5 and a pressure roll 14 for applying a pressure onto the toners 5 on the sheet 10 in conjunction with the heat roll 13, to thereby form a final image.

On the one hand, the toners 5 that are not transferred and which remain on the photosensitive body 1 are removed from the surface of the photosensitive body 1 by a cleaning unit.

A patch sensor 17, which detects the image density of a recorded image that has been transferred onto the sheet 10 by the image transfer unit 11, is disposed between the image transfer unit 11 and the fixing unit 12. A patch image 16 which is used for detecting the image density of the recorded image is developed, the density of the patch image 16 is read by the patch sensor 17, and the image density of the recorded image is detected.

Further, a high voltage power source 18, which applies a bias voltage to the developing roll 7 in the developing unit 4, is disposed near the developing unit 4 and is connected to a control unit 19, such as a CPU, which operates to detect a current flowing to the photosensitive body 1 from the developing roll 7. The patch sensor 17 is also connected to the control unit 19 to which the image density of the patch image 16 is always inputted. The developing conditions are controlled based on this input data. The above-described processes are performed repeatedly.

The image quality stabilization control means of the present invention will be explained. The image density of a recorded image is detected by the patch sensor 17, and the detected value is fed back to the control unit 19. The value is compared with an image density reference range set in the control unit 19; and, when the image density detected value is within the image density reference range, the printing operation is continued.

An instance where the image density detection value deviates from the image density reference range for of reason will be explained. An example in which the detection value exceeds the upper limit value of the image density reference range will be considered. In this instance because the image density is dense, the detection value exceeds the image density reference range. First, the printing operation is temporarily stopped, the current flowing into the photosensitive body 1 from the high voltage power source 18 that applies the bias voltage is detected, and the detected current value is sent to the control unit 19, so as to determine whether the detected value is within a reference flow-in current range.

A method of detecting the current flowing to the photosensitive body 1 from the high voltage power source 18 will be explained briefly. A current is detected which flows into the photosensitive body 1 through the developing agent 6 existing on the developing roll 7 in the developing unit 4 that is disposed in facing relationship to the photosensitive body 1. The detection method is such that the photosensitive body 1 is charged to a predetermined voltage, and, thereafter, the bias voltage applied to the developing unit is set to 0V. The detected current value at this moment is inputted to the control unit 19. Since this current flows into the developing unit 4 through the developing agent 6, the detected current can be converted into a resistance value of the developing agent 6.

In the above-described manner, it is judged whether the flow-in current inputted into the control unit 19 is within the flow-in current reference range set in the control unit. When the detected flow-in current is within the set reference range, both the bias voltage and the toner density, which represents the toner ratio in the developing agent 6, are controlled so that the image density of the recorded image is restored within the image density reference range set in the control unit 19. Further, when the detected flow-in current value exceeds the upper limit value of the flow-in current reference range, only the bias voltage is controlled in an attempt to restore the image density of the recorded image within the image density reference range set in the control unit 19.

As has been explained above, since the flow-in current can be converted into a resistance value of the developing agent 6, the instance where the flow-in current exceeds the upper limit value of the flow-in current reference range that the resistance of the developing agent has decreased. In this instance, since the resistance of the developing agent is reduced, the image density becomes dense and exceeds the image density reference range set in the control unit 19. Accordingly, when control for reducing the toner density is performed, since the resistance of the developing agent is further reduced, the image density of the record image sometimes may not be restored. For this reason, through the control of only the bias voltage, the restoration of the image density within the image density reference range is attempted. With this bias voltage control, if the image density is not restored within the reference range, the toner density control is added. On the other hand, when the detected flow-in current exceeds the lower limit of the flow-in current reference range, in the same manner as described above, but in the opposite direction, through the control of only the bias voltage, the restoration of the image density within the image density reference range is attempted. If the attempt at restoration fails with use of the bias voltage control alone, the toner control is also performed.

According to the present invention, even if a problem due to an abnormality in the developing agent property is caused during a predetermined number of printing operations, for any reasons, a stable image density control, which represents a countermeasure to the problem, can be provided. Further, image density stabilization control using such a patch sensor, for example, can always provide a stable image density, even if a change is caused due to an abnormality in the developing agent property.

The invention claimed is:

1. An image forming device which is provided with a developing unit for developing an electrostatic latent image that has been formed on an image carrying body to produce a toner image by utilizing a two component developing agent containing toners and carriers, which toner image is transferred and fixed on a recording medium to obtain a record image, the image forming device further comprising a patch sensor for detecting the image density of the record image, and means for controlling a stabilization control and adjustment value of toner density in the developing unit and a bias voltage between the image carrying body and the developing unit according to a value detected by the patch sensor and a value of current flowing in the image carrying body from the developing unit, wherein when a detected value of current flowing in the image carrying body from the developing unit exceeds a flow-in current reference range, the bias voltage between the image carrying body and the developing unit is for the first time controlled so as to restore the image density of the record image.

* * * * *